United States Patent [19]

Bosch et al.

[11] 4,255,608

[45] Mar. 10, 1981

[54] TEMPORARY ELECTRICAL GROUNDING ROD BARRICADE APPARATUS

[75] Inventors: Mahlon L. Bosch; Jason S. Kehl, both of Centralia, Mo.

[73] Assignee: A. B. Chance Company, Centralia, Mo.

[21] Appl. No.: 92,996

[22] Filed: Nov. 9, 1979

[51] Int. Cl.[3] ..... H01R 4/66

[52] U.S. Cl. ..... 174/5 R; 174/7

[58] Field of Search ..... 174/5 R, 5 SB, 5 SG, 174/6, 7

[56] References Cited

U.S. PATENT DOCUMENTS 1,290,881 1/1919 Becker ..... 174/7

*Primary Examiner*—Laramie E. Askin

*Attorney, Agent, or Firm*—Schmidt, Johnson, Hovey & Williams

[57] ABSTRACT

Apparatus is disclosed for preventing a person from coming into dangerously close proximity with an earth-embedded temporary electrical grounding rod so as to lessen the likelihood of electrical shock in the event of a fault current. The overall protective device of the invention includes an earth-embedded, temporary, electrical grounding rod, a mounting collar threadably secured to the upper end of the grounding rod, and a plurality of insulative, elongated struts removably secured to the collar and extending outwardly and obliquely therefrom. A perimeter-defining rope element extends about the grounding rod in a laterally spaced, elevated position relative thereto, and is supported by the oblique struts.

8 Claims, 4 Drawing Figures

FIG. 1
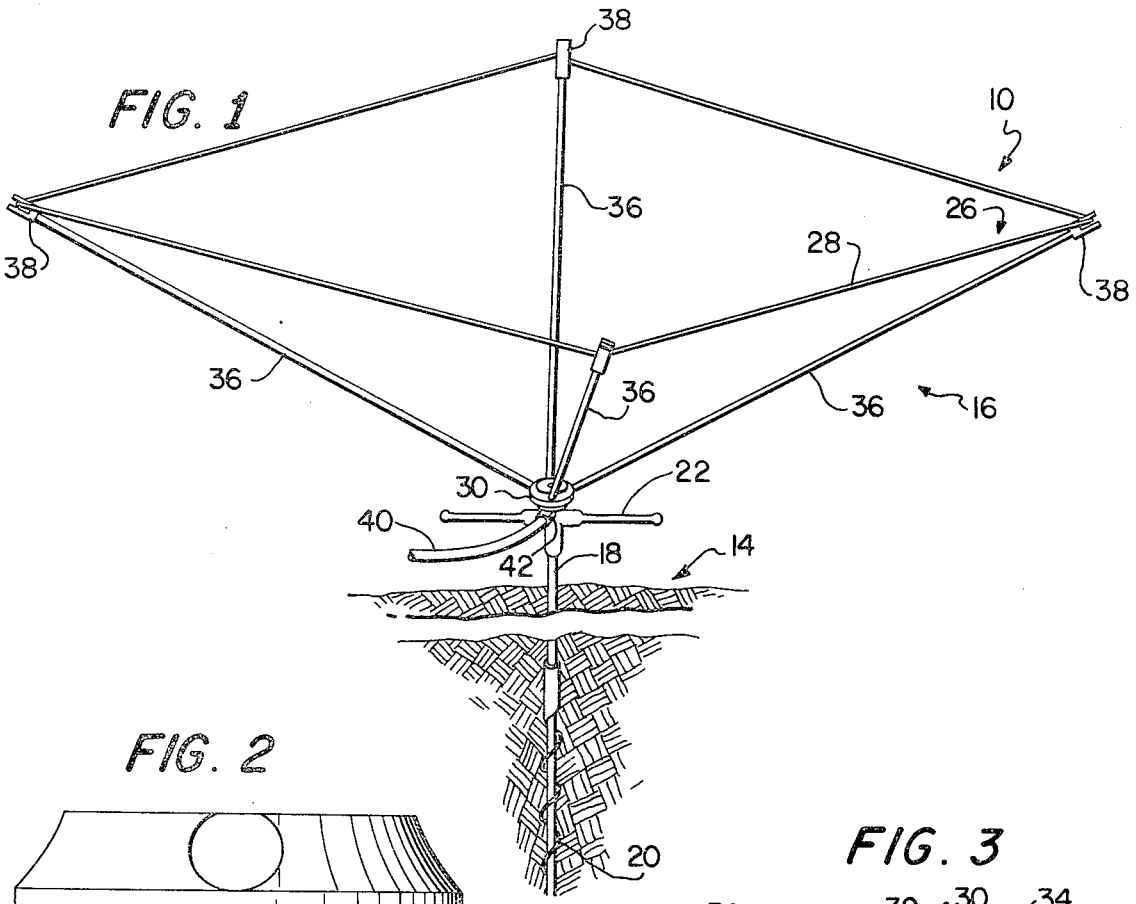
FIG. 2
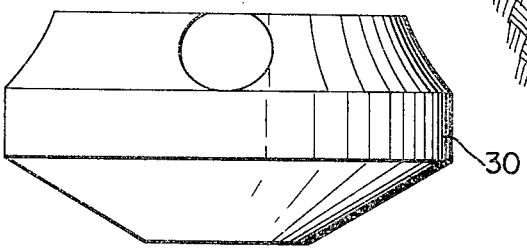
FIG. 3
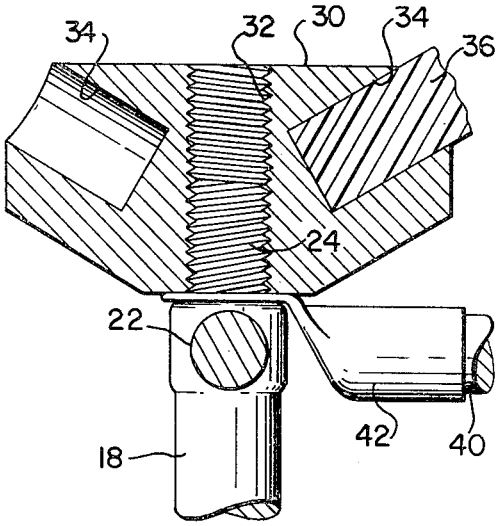
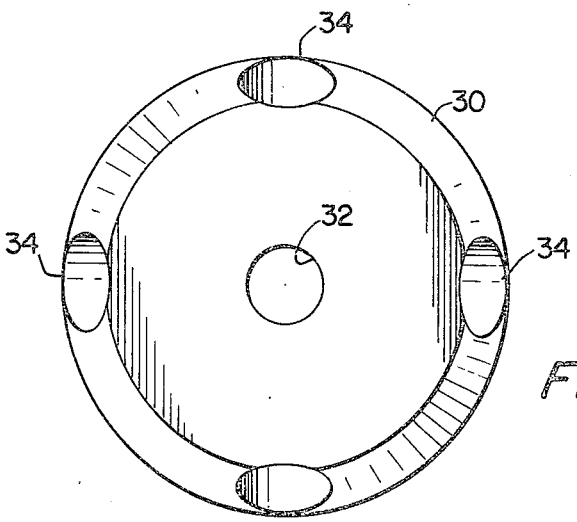
FIG. 4

TEMPORARY ELECTRICAL GROUNDING ROD BARRICADE APPARATUS

BACKGROUND OF THE INVENTION

1. Field of the Invention

The present invention is concerned with a protective device for preventing a person from coming into close proximity with an electrical grounding rod. More particularly, it is concerned with a protective device in the form of a barrier which surrounds the grounding rod and is elevated relative to the rod so that a lineman or other person will be prevented from walking into dangerously close proximity to the grounding rod.

2. Description of the Prior Art

The use of temporary electrical grounding rods is an important safety feature universally followed by utilities. Such rods are used to provide an electrical ground for electrical lines or equipment being worked on, for example. Thus when a section of electrical power line has been de-energized, a temporary grounding rod is used to assure that the line is maintained at ground potential. Nevertheless, an extreme danger can occur when a fault current passes through the line and grounding rod. This may occur through lightning or by accidental energization of the supposedly de-energized line. Moreover, the danger of electrical shock is not limited solely to the grounding rod itself, but can occur if a person is in close proximity (i.e., within a few feet) of the embedded rod.

Accordingly, there is a need for a protective assembly for preventing a person from approaching too close to the grounding rod, thus assuring the person's safety. Such an assembly must be quickly and easily installable by virtue of the temporary nature of the rod and because it will be installed under varying conditions in the field.

SUMMARY OF THE INVENTION

The above problems are in large measure solved by the present invention which provides a barricade to restrict a person from coming into dangerously close proximity to a temporary grounding rod. The invention broadly includes perimeter-defining means which circumscribes the grounding rod and is in laterally spaced relationship thereto. Structure is also provided for supporting the perimeter-defining means in an elevated position to enhance the barrier effect thereof.

In particularly preferred forms, the perimeter-defining means is in the form of a continuous rope element that is operably connected to a plurality of spaced, insulative, elongated, supporting struts. The support struts are obliquely oriented and removably connected to a mounting collar attached to the grounding rod, so that the rope element is positioned in an elevated location circumscribing the grounding rod. The invention thus serves to restrain a person from approaching dangerously close to the grounding rod; at the same time, the elevated rope barrier is high enough so as to not present a hazard of tripping an unsuspecting passerby.

BRIEF DESCRIPTION OF THE DRAWING

FIG. 1 is a fragmentary perspective view of the overall protective device of the invention, shown operatively assembled as it would appear in the field;

FIG. 2 is a side elevational view of the connection collar forming a part of the device;

FIG. 3 is a fragmentary vertical sectional view illustrating the uppermost end of a grounding rod, with a strut-supporting connection collar threadably secured thereto; and FIG. 4 is a plan view of the connection collar, illustrating the central bore and circumferentially spaced strut-receiving bores.

DESCRIPTION OF THE PREFERRED EMBODIMENT

Turning now to the drawing, FIG. 1 illustrates a protective device 10 in accordance with the invention. Device 10 broadly includes an elongated electrical grounding rod 14 imbedded into the earth, along with structure broadly referred to by the numeral 16 for preventing a person from coming into close proximity with rod 14.

In more detail, the rod 14 is of conventional construction and includes an elongated, metallic shank 18 having a helical auger blade 20 thereon to fcilitate insertion of the rod 14 into the earth. In addition, rod 14 includes an upper, elongated, transversely extending insertion handle 22. The uppermost end of the shank 18 is provided with an upwardly extending, threaded element 24.

Structure 16 includes barricade-like perimeter defining means 26 located in laterally spaced, circumscribing relationship to the rod 14 and in an elevated relationship therefrom (see FIG. 1). The perimeter-defining means is preferably in the form of an elongated, continuous rope element 28.

Structure 16 also includes support means for the element 28. Preferably, this support means includes an annular metallic collar 30 having a central, threaded bore 32 therethrough, along with four circumferentially spaced strut-receiving bores 34 in the periphery thereof. As best seen in FIGS. 3 and 4, the respective bores 34 are oriented at an oblique relationship relative to the longitudinal axis of threaded bore 32.

Each bore 34 receives a respective elongated, insulative strut 36 in the manner best illustrated in FIG. 1, i.e., with the struts extending upwardly and outwardly relative to collar 30 and rod 14. The uppermost end of each rod 36 is equipped with a bifurcated, rope-supporting fitting 38 which is adapted to releasably receive the rope element 28.

In the use of protective device 10, rod 14 is first inserted into the earth using handle 22, whereupon a conventional grounding lead 40 having an apertured ferrule 42 (see FIG. 3) is operatively slipped over element 24. At this point collar 30 is threaded onto element 24 in order to secure the collar firmly onto the rod, and to create a proper electrical connection between the ferrule 42 (and thus the lead 40) and the rod 14. At this point the respective struts 36 are operatively positioned within the corresponding bores 34 so that the struts assume the oblique, outwardly extending orientation best seen in FIG. 1. The final step in the installation of the barricade apparatus involves slipping the continuous rope element 28 into the uppermost end fittings 38 on the separate rods 36.

When the structure 16 is installed on the rod 18 as aforesaid, it will be appreciated that an elevated, laterally spaced barricade about the rod 18 is presented. Hence, workmen and others are positively prevented from coming into dangerous close proximity with the rod 18. In addition, the elevated disposition of the rope element 28 assures that unsuspecting passersby will not inadvertently trip over the rope element and thereby possibly come into physical contact with the grounding rod assembly.

It will also be observed that the structure 16 is adapted for connection to a conventional grounding rod, and that the respective components of the protective structure can be readily assembled in the field to provide a truly effective yet temporary protective device.

Having thus described the invention, what is claimed as new and desired to be secured by Letters Patent is:

1. A protective device, comprising:

an elongated electrical grounding rod for insertion into the earth; and structure for preventing a person from coming into close proximity with said grounding rod when the latter is installed in the earth, including electrically insulative perimeter-defining means located in a position circumscribing said rod and in a laterally spaced, elevated relationship to said rod; and means supporting said perimeter-defining means in said position, said support means including a plurality of support struts operatively connected to said perimeter-defining means and extending from the latter to a point closely adjacent said rod.

2. The protective device as set forth in claim 1 wherein said structure comprises:

a continuous rope element;

a plurality of insulative, elongated struts;

means operatively connecting said struts to said element;

a collar;

means securing said collar to the upper end of said grounding rod; and means coupling said struts to said collar.

3. The protective device as set forth in claim 2 wherein said coupling means include structure supporting said struts at an oblique angle relative to the longitudinal axis of said grounding rod.

4. The protective device as set forth in claim 2 wherein said collar is configured to present a threaded bore therein.

5. Barricade apparatus for use with an earth-embedded grounding rod, comprising:

structure for preventing a person from coming into close proximity with said grounding rod, including;

perimeter-defining means located in a position circumscribing said rod in a laterally spaced, elevated relationship to said rod;

means supporting said perimeter-defining means in said position, comprising; a plurality of insulative, elongated struts;

means operatively connecting one end of said struts to said perimeter-defining means; and means coupling the other end of said struts to said rod.

6. The apparatus as set forth in claim 5 wherein said coupling means comprises a collar, and means securing said collar to said rod.

7. The apparatus as set forth in claim 6 wherein said collar is configured to present a bore therein.

8. The apparatus as set forth in claim 5 wherein said coupling means includes structure supporting said struts at an oblique angle relative to the longitudinal axis of said grounding rod.

* * * * *